US007959041B2

(12) United States Patent
Miller et al.

(10) Patent No.: US 7,959,041 B2
(45) Date of Patent: Jun. 14, 2011

(54) VALVE ASSEMBLY FOR PRESSURIZED DISPENSERS

(75) Inventors: Allen D. Miller, Racine, WI (US); Leon C. Samuelson, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 519 days.

(21) Appl. No.: 12/198,558

(22) Filed: Aug. 26, 2008

(65) Prior Publication Data

US 2010/0051653 A1 Mar. 4, 2010

(51) Int. Cl.
*B65D 83/00* (2006.01)

(52) U.S. Cl. ..... 222/402.16; 222/402.1; 222/402.23; 141/20

(58) Field of Classification Search ..... 222/402.16, 222/402.1, 402.17, 402.24, 402.18, 402.19, 222/402.22, 402.23, 388–389, 394; 141/15, 141/18, 20, 2–5, 10
See application file for complete search history.

(56) References Cited

U.S. PATENT DOCUMENTS

| | | | | |
|---|---|---|---|---|
| 3,158,297 | A | 11/1964 | Ferry, Jr. et al. | |
| 3,158,298 | A | 11/1964 | Briechle | |
| 3,176,727 | A | 4/1965 | Rousseau | |
| 3,179,310 | A | 4/1965 | Steiman | |
| 3,219,069 | A | 11/1965 | Kuffer | |
| 3,375,957 | A | 4/1968 | Kuffer | |
| 3,394,851 | A | 7/1968 | Gorman | |
| 3,400,864 | A * | 9/1968 | Frangos | 222/402.16 |
| 3,406,877 | A * | 10/1968 | Frangos | 222/402.1 |
| 3,490,651 | A * | 1/1970 | Abplanalp | 222/94 |
| 3,497,112 | A * | 2/1970 | Samuelson | 222/148 |
| 3,520,450 | A * | 7/1970 | Mason et al. | 222/94 |
| 3,583,606 | A * | 6/1971 | Ewald | 222/402.18 |
| 3,640,436 | A | 2/1972 | Gallagher | |
| 3,651,997 | A | 3/1972 | Venus, Jr. | |
| 3,674,185 | A | 7/1972 | Evesque | |
| 3,709,410 | A | 1/1973 | Cunningham | |
| 3,745,741 | A | 7/1973 | Cunningham et al. | |
| 3,827,608 | A * | 8/1974 | Green | 222/402.16 |
| 3,982,674 | A * | 9/1976 | Mildern | 222/402.21 |
| 4,148,419 | A | 4/1979 | MacNair | |
| 4,216,884 | A * | 8/1980 | Giuffredi | 222/402.16 |
| 4,247,024 | A * | 1/1981 | Vogel | 222/402.16 |
| 4,271,875 | A | 6/1981 | Meshberg | |
| 4,441,634 | A | 4/1984 | Meshberg | |
| 4,863,073 | A * | 9/1989 | Burt et al. | 222/402.2 |

(Continued)

FOREIGN PATENT DOCUMENTS

| | | |
|---|---|---|
| EP | 1473246 | 4/2003 |

*Primary Examiner* — Frederick C. Nicolas

(57) ABSTRACT

An improved valve assembly for use in a pressurized dispenser is disclosed. The disclosed valve assembly may include a valve housing and a blocking member operatively associated with the valve housing, wherein the wall of the valve housing includes at least one transverse primary opening and at least one transverse secondary opening thereon. The blocking member is slidable from a filling position, in which fluid communication between the interior and exterior of the valve housing is established through both primary and secondary openings, to a dispensing position, in which fluid communication between the interior and exterior of the valve housing is established only through the primary opening and not through the secondary opening. The blocking member may include a slidable sleeve, a slidable piston plate, or a combination of both. In operation, the disclosed valve member may provide an increased flow rate during product and/or propellant filling while retaining a regular flow rate during dispensing.

25 Claims, 11 Drawing Sheets

U.S. PATENT DOCUMENTS 4,969,577 A 11/1990 Werding
RE33,552 E * 3/1991 Bougamont et al. ..... 222/402.16
5,211,316 A 5/1993 Adalberto et al.
5,348,199 A 9/1994 Smith
5,605,258 A 2/1997 Abplanalp
RE35,540 E 6/1997 Davies et al.
5,669,426 A * 9/1997 Fontaine, Jr. ..... 141/21
5,690,256 A 11/1997 Smith
5,695,096 A * 12/1997 Yquel ..... 222/402.18
5,906,046 A 5/1999 Abplanalp et al.
5,915,598 A * 6/1999 Yazawa et al. ..... 222/402.1
5,941,424 A * 8/1999 Hildebrandt ..... 222/148
6,070,770 A 6/2000 Tada et al.
6,152,190 A 11/2000 Smith
6,161,599 A 12/2000 Smith
6,279,623 B1 8/2001 Smith
6,283,171 B1 9/2001 Blake
6,375,046 B1 * 4/2002 Alleard et al. ..... 222/386.5
6,394,364 B1 5/2002 Abplanalp
6,698,620 B2 * 3/2004 Ogata et al. ..... 222/95
6,745,920 B2 6/2004 Gupta
6,758,373 B2 7/2004 Jackson
7,124,788 B2 10/2006 Pericard
7,222,646 B2 5/2007 Gupta
7,357,158 B2 * 4/2008 Yerby et al. ..... 141/9
7,730,911 B2 * 6/2010 Pericard ..... 141/20
2004/0003864 A1 1/2004 Bloome et al.
2007/0006937 A1 1/2007 Pericard
2007/0006938 A1 1/2007 Pericard
2007/0119874 A1 5/2007 Geier et al.

* cited by examiner

VALVE ASSEMBLY FOR PRESSURIZED DISPENSERS

BACKGROUND OF THE DISCLOSURE

1. Technical Field

An improved valve assembly for use in a pressurized dispenser is disclosed. The valve member provides faster product and/or propellant filling. The disclosed valve assembly may include a valve housing and a blocking member disposed within the valve housing, wherein the valve housing includes at least one transverse primary opening and at least one transverse secondary opening thereon. The blocking member is movable from a filling position, in which the product and/or propellant may be charged into the dispenser through both the primary and secondary openings, to a dispensing position, in which the product and/or propellant may be dispensed from the dispenser only through the primary opening and not through the secondary opening.

2. Description of the Related Art

Pressurized dispensers have been commonly used to store and dispense personal, household, industrial, and medical products, and provide a low cost, easy to use method of dispensing products that are best used as an airborne mist or as a thin coating on surfaces. The pressurized dispensers generally include a sealed container closed at one end and having a dispensing valve assembly on the other end for controlled filling or dispensing of the products contained therein. The products to be dispensed include a wide variety of liquid products, such as cleansers, insecticides, paints, deodorants, disinfectants, air fresheners, etc. A propellant may be used to discharge the liquid product from the dispenser. The propellant is pressurized and provides a force to expel the liquid product from the dispenser through the dispensing valve assembly when a user actuates the pressurized dispenser by pressing an actuator button or trigger.

In general, the pressurized dispensers may be single-chambered, in which the propellant and product are mix with each other, or multi-chambered, in which the propellant and product are separated. In a single-chambered pressurized dispenser, the dispenser is charged with the liquid product and propellant through the valve assembly to a pressure approximately equal to or slightly greater than the vapor pressure of the propellant, thereby allowing some of the propellant to be dissolved or emulsified in the liquid product. The remainder of the propellant remains in the vapor phase and fills the head space of the dispenser.

During dispensing, the valve assembly is depressed to expose a dispensing passageway therein and cause both the product and the propellant to be dispensed from the dispenser. As the product is dispensed, the pressure in the dispenser remains approximately constant as liquid propellant may move from the liquid phase into the vapor phase thereby replenishing discharged propellant vapor. Single-chambered pressurized dispensers have the benefit of simpler design and lower production cost.

Multi-chambered pressurized dispensers, on the other hand, may have a variety of configurations, including bag-on-valve, bag-on-can or piston designs. In general, the container of the dispenser is divided by a barrier member into product and propellant chambers. The barrier member may be a bag sealed to the valve assembly, a bag sealed to the container wall, or a piston member slidably disposed within the container. Generally, the product is charged into the product chamber through the valve assembly, whereas the propellant is charged into the propellant chamber through either the valve assembly or a charging orifice provided on the container wall.

Because the valve assembly provides fluid passageways during the filling and dispensing operations of the pressurized dispenser, a valve assembly specifically designed to accommodate optimum efficiency of both operations is highly desirable. For example, increasing product flow through the valve assembly during the filling operation expedites the manufacturing process of the pressurized dispenser. However, the increased product flow may adversely affect the spray characteristics of the dispenser. Thus, there is a need for a valve assembly that provides an increase flow rate during product filling while retaining a regular flow rate during product dispensing.

Valve assemblies that accommodate both product filling and dispensing by modifying flow paths are well known in the art. For example, a valve assembly adapted for fast pressure filling and metered dispensing of a product may include a valve body having a top and a bottom, a valve stem inserted through the top of the valve body, and a piston-like member disposed within and connected to the bottom of the valve body. The valve stem is connected to the piston-like member through a spring. The bottom of the valve body includes a center opening and an annular opening formed between a cylindrical flange of the piston-like member and the interior cylindrical surface of the valve body. In product dispensing, the product is dispensed through the center opening while the annular opening is closed by a biasing force of the flange against the interior surface of the valve body. In pressure filling, however, the valve stem is depressed thereby blocking the center opening. The pressure of the product then flows through the annular opening against the biasing force of the flange.

In another example, a valve assembly includes a valve body having a bottom opening, a valve stem inserted through the top of the valve body, and a spring connecting the bottom of the valve stem to the middle portion of the valve body. The valve body further includes a bottom slit extending from the bottom opening thereby enabling the radial expansion of the bottom opening when the valve housing is under high pressure. As a result of such expansion, the flow rate of the aerosol product during pressure filling can be substantially increased. Nevertheless, additional product filling paths achieved in both of the aforementioned examples require the deformation of delicate structural components, which may increases the production cost and decrease the robustness and reliability of the valve assembly.

Valve assemblies that use a guiding sleeve to block/unblock openings on the valve body in order to regulate the flow paths during product and/or propellant filling are also known in the art. For example, a known dual-chamber aerosol package includes an outer container, an inner container disposed in the outer container and a multi-functional dispensing valve. The dispensing valve includes a valve body, a valve stem inserted through the top opening of the valve body, and a guide sleeve slidably disposed within the valve body. The valve body further includes a bottom filling opening and a transverse side dispensing opening, wherein the bottom and side openings are in communication with the inner and outer containers, respectively. During a filling process, the guide sleeve blocks the dispensing opening and allows pressurized gas to be filled into the inner container through the bottom opening. At the end of the filling process, the guide sleeve is advanced to block the bottom opening while simultaneously unblocking the side dispensing opening, through which the product is dispensed. However, rather than increasing the flow rate during product filling and retaining regular flow rate during product dispensing, the guiding sleeve simply functions to regulate the direction of flow paths into the corresponding product and propellant chambers.

Hence, there is a need for a valve assembly for use in a pressurized dispenser to modulate the flow rate during product filling and dispensing. Moreover, there is a need for a valve assembly for use in a pressurized dispenser that provides increased product filling rate while retaining regular product dispensing rate. Further, there is a need for a flow-modulating valve member that is durable, robust, and economical to manufacture.

SUMMARY OF THE DISCLOSURE

This disclosure is directed toward a flow-modulating valve assembly for use in a pressurized dispenser. During filling, the product may be charged through one or more primary flow passages and one or more secondary flow passages into the dispenser, thereby achieving an increased flow rate for faster filling. During dispensing, on the other hand, the product may be dispensed through the one or more primary passages only, and not through the one or more secondary passages, thereby retaining a regular flow rate for controlled dispensing of the product.

The disclosed valve assembly may include a valve housing having a top portion sealed against the top opening of a pressurized container, and a bottom portion inserted into the interior space of the container. The valve assembly may further include a valve stem inserted through, and sealed against, a top opening of the valve housing. The valve stem may include an internal passageway through which the product and/or propellant is charged into, or discharged from, the pressurized container.

In a general embodiment, the disclosed valve assembly may further include one or more transverse primary openings and one or more transverse secondary openings disposed on the valve housing, as well as a blocking member operatively coupled to the valve housing. During product filling, the product and/or propellant may be charged into the pressurized dispenser through both the primary and secondary openings. During product dispensing, on the other hand, the blocking member blocks the one or more secondary openings, thereby allowing the product to be dispensed only through the one or more primary openings at a regular flow rate.

More specifically, the primary and secondary openings may be provided on the sidewall and/or bottom of the valve housing. In one embodiment, the one or more primary openings and the primary flow passage may be provided on the bottom of the valve housing, while the at least one secondary opening and secondary flow passage may be provided on either the bottom or the sidewall of the valve housing. The primary and secondary openings may be of any shape and size, and may be provided at any suitable location on the valve housing as long as the openings accommodate the blocking/unblocking operation of the blocking member during product filling and dispensing, as disclosed in greater detail below.

In one embodiment, in which the one or more primary openings are provided on the bottom and the one or more secondary openings are provided on the sidewall of the valve housing, the blocking member may include a slidable sleeve having a sidewall that at least partially engages the sidewall of the valve housing. During product filling, the blocking member may be positioned so that neither of the primary and secondary openings on the valve housing is blocked by the sleeve, thereby increasing the product flow rate during the filling process. Upon completion of product filling, the blocking member may be repositioned so that the one or more secondary openings on the sidewall of the valve housing are blocked by the sleeve, thereby allowing the product to be dispensed only through the one or more primary openings at a regular flow rate.

In another embodiment, in which both primary and secondary openings are provided on the bottom wall of the valve housing, the blocking member may include a slidable piston plate having one or more transverse primary vents and one or more transverse secondary vents thereon. The one or more primary vents are in longitudinal registry with the one or more primary openings on the bottom wall of the valve housing, and the one or more secondary vents are not in longitudinal registry with the one or more secondary openings on the bottom wall of the valve housing.

During product filling, the blocking member may be positioned so that the piston plate is separated from the bottom wall of the valve housing, thereby allowing product to be charged into the interior of the pressurized container first through the primary and secondary vents on the piston plate, and then through the primary and secondary openings on the bottom of the valve housing. Upon completion, the blocking member may be repositioned so that the piston plate fully engages the bottom wall of the valve housing. Because the one or more secondary vents on the piston plate are not in longitudinal registry with the one or more secondary openings on the bottom wall of the valve housing, the product may only by dispensed through the one or more primary vents and openings at a regular flow rate.

In a further embodiment, in which the one or more secondary openings are provided on the sidewall as well as the bottom wall of the valve housing, the blocking member may include both the sleeve and the piston plate discussed above. During product filling, the blocking member may be positioned so that the sleeve does not block the one or more secondary openings on the sidewall of the valve housing, and the piston plate is separated from the bottom wall of the valve housing. Accordingly, the product may be charged into the interior of the pressurized container first through the primary and secondary vents on the piston plate, and then through the primary openings, as well as the secondary openings on the sidewall and bottom of the valve housing.

Upon completion, the blocking member may be repositioned so that the sleeve blocks the one or more secondary openings on the sidewall of the valve housing, and the piston plate fully engages the bottom wall of the valve housing. As a result, the one or more secondary openings on the side and bottom wall of the valve housing are blocked by the blocking member, and the product may only be dispensed through the one or more primary openings on the valve housing at a regular flow rate.

The positioning of the blocking member in the disclosed valve assembly may be accomplished by a wide variety of mechanisms known in the art. For example, positioning of the blocking member is achieved by sliding the blocking member longitudinally along the valve housing. In one embodiment, the sliding movement of the blocking member may be actuated by the valve stem through one or more spring members operatively associated with the blocking member and the valve stem. Optionally, the blocking member may also be operatively associated with the valve housing through one or more mechanical components, such as one or more spring members.

The blocking member may be manufactured from the same or similar material as the valve body, or it may be made of any other material that does not significantly deform or fracture under the pressure within the dispenser. Moreover, the material from which the blocking member is manufactured should be substantially impermeable to the product and/or propellant in order for the blocking member to effectively block the one or more secondary openings on the valve housing.

Other advantages and features will be apparent from the following detailed description when read in conjunction with the attached drawings. It will also be noted here and elsewhere that the valve assembly disclosed herein may be suitably modified to be used in a wide variety of pressurized or non-pressurized dispensers by one of ordinary skill in the art without undue experimentation.

BRIEF DESCRIPTION OF THE DRAWINGS

For a more complete understanding of the disclosed valve assembly, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed barrier member or which render other details difficult to perceive may have been omitted. It should also be understood, of course, that this disclosure is not limited to the particular embodiments illustrated herein, but rather it is the intention of this disclosure to also cover all modifications, alternative constructions, and equivalents of the disclosed embodiments as well.

DETAILED DESCRIPTION OF THE DISCLOSURE

Figure 1:
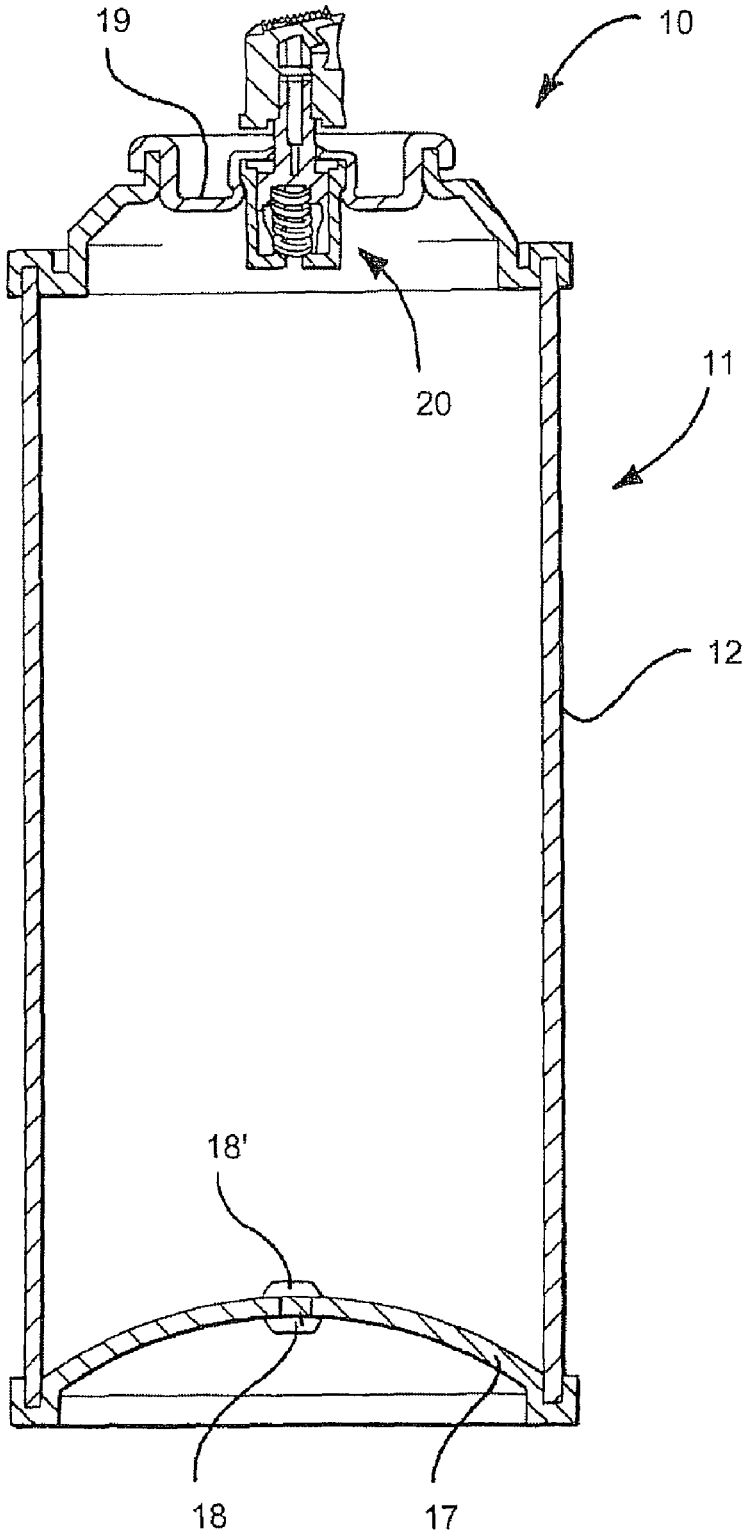
FIG. 1 is a side sectional view of a conventional valve assembly in a pressurized dispenser.

Referring now to the drawings, and with specific reference to FIG. 1, a conventional pressurized dispenser is generally referred to as reference numeral 10. While the dispenser 10 may be an aerosol dispenser, and have the type of actuator depicted, it is to be understood that this is but one example of the types of the dispensers in which the valve assembly of the present disclosure can be employed. Again with reference to the pressurized dispenser 10, it is shown to include a container 11 having a cylindrical wall 12 formed of a flat piece of sheet metal. Attached to the bottom edge of the sidewall 12 is a bottom wall 17, which may have an optional center charging orifice 18, through which a propellant may be charged into the container 11. The charging orifice 18 may be closed by a resilient plug 18' after the propellant is charged. Crimped to the top edge of the side wall 12 is a mounting cup 19 having a large center opening, through which a valve assembly 20 is inserted. A mounting gasket (not shown) may be disposed between an upper rim of the container 11 and the underside of the mounting cup 19. The container 11 may be one-piece or multiple-piece, metal or plastic, straight-walled or necked. The container 11 may also have a cross sectional profile of an oval or any other shapes known in the art. It is to be understood that this disclosure is not limited to the container described herein. Other containers of various shapes, methods of construction, structures and materials may also be used with the disclosed valve assembly by one of ordinary skill in the art.

Figure 2:
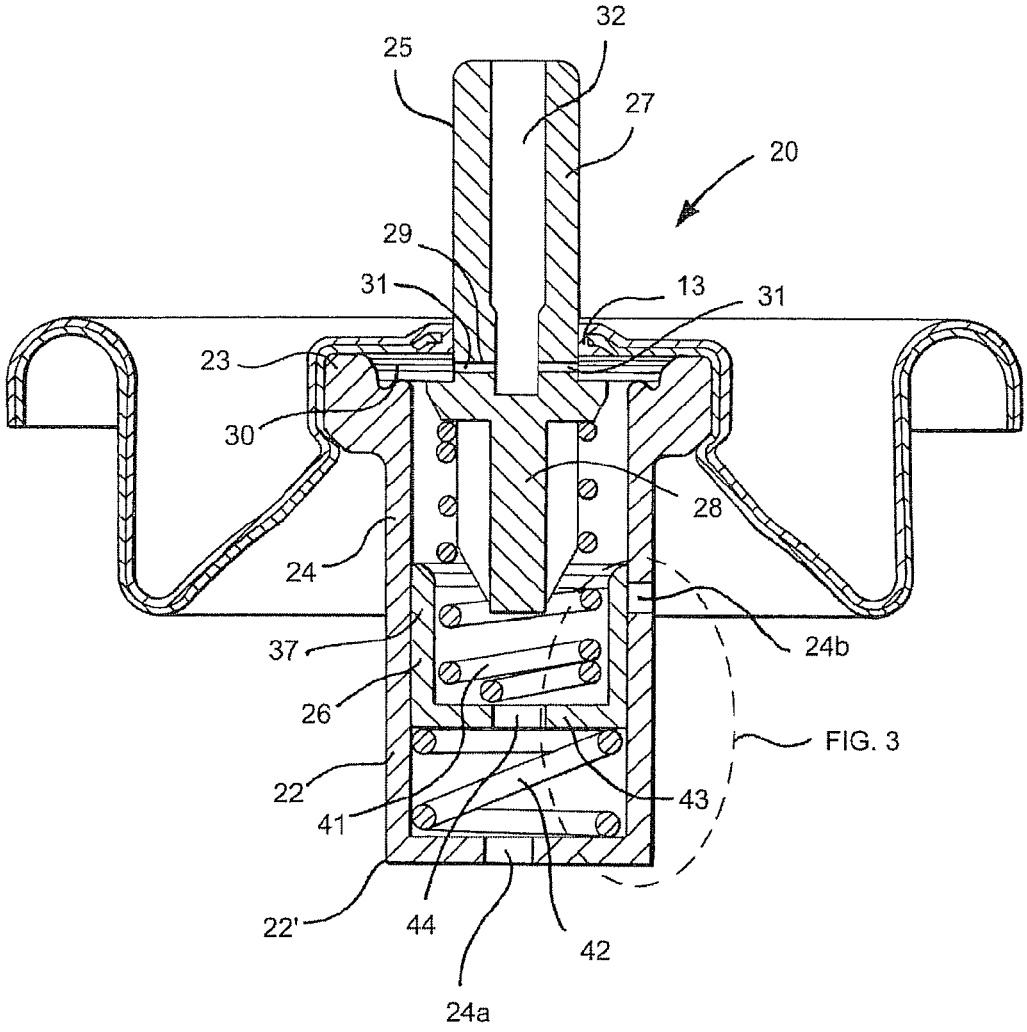
FIG. 2 is an side view of one embodiment of the disclosed valve assembly in accordance with this disclosure.

FIGS. 2-5 illustrate a first non-limiting embodiment of the disclosed valve assembly. Referring to FIG. 2, the valve assembly 20 generally includes a valve housing 24, a valve stem 25, and a blocking member 26. An upper rim 23 of the valve housing 24 is affixed to the underside of the mounting cup 19 by a friction fit, thereby providing a seal against the container 11. The lower portion 22 of the valve housing 24 is inserted into the interior space of the container 11. The lower end 22' of the valve housing 24 may also be connected to an optional dip tube (not shown). The valve housing 24 may include one or more transverse primary openings 24*a* and one or more transverse secondary openings 24*b*, through which the product may be charged into, or dispensed from, the pressurized container 11. It is important to note that the location of the primary and secondary openings (24*a*, 24*b*) in FIG. 2-5 are for illustration purpose only, and therefore should not be considered as limiting the scope of this disclosure.

The valve stem 25 is inserted through a center opening 13 of the mounting cup 19. The valve stem 25 includes a top portion 27 disposed outside of the container 11, a bottom portion 28 disposed within the interior of the valve housing 24, and a middle portion 29 sealed against the upper rim 23 of the valve housing 24 through an annular gasket 30. The middle portion 29 of the valve stem 25 may further include one or more stem orifices 31 connected to a fluid passageway 32, through which the product and/or propellant are charge into and, or dispensed from, the container 11. When the valve stem 25 is not activated, the stem orifice 31 is blocked by the annular gasket 30 or other structural component(s) of the valve assembly if the annular gasket 30 is omitted. During filling or dispensing, however, the valve stem 25 may be repositioned by sliding, tilting or any other mechanism known in the art so that the stem orifice 31 is no longer blocked by the annular gasket 30, thereby establishing fluid communication between the interior of the valve housing and the fluid passageway 32 for filling or discharging of the product and/or propellant.

It is to be understood that the valve housing 24 and valve stem 25 described above are merely one example of many embodiments apparent to those of ordinary skill in the art. For example, gaskets may or may not be required between the valve housing 24 and the mounting cup 19, and between the valve stem 25 and the mounting cup 19, depending upon the materials used for each component. Suitable materials that permit a gasket-less construction will be apparent to those skilled in the art.

Still referring to FIG. 2, the blocking member 26 of the disclosed valve assembly 20 may include a sleeve 37 operatively coupled to the valve housing 24. The sleeve 37 may have an exterior surface that at least partially engages the interior surface of the valve housing 24. The sleeve 37 may be longitudinally slidable within the valve housing 24 so that the engagement of the sleeve 37 and the valve housing 24 may selectively block or unblock the one or more secondary openings 24*b* on the sidewall of the valve housing 24. Preferably, the blocking member may not block the one or more primary openings 24*a* on the valve housing 24. In the embodiment illustrated in FIG. 2, in which the primary opening 24*a* is provided on the bottom of the valve housing, the blocking member 26 may have an open bottom end (not shown) or a bottom wall 43 with an opening 44 that is in axial alignment or longitudinal registry with the primary opening 24*a* of the valve housing 24. Nevertheless, the one or more primary openings may also be provided on the sidewall or both the sidewall and bottom of the valve housing 24 (not shown), in which case one of ordinary skill in the art may shape the sleeve 37 of the blocking member 26, such as by providing recesses, slots or other structural features on the sleeve 37, so that the sliding movement of the blocking member does not block the one or more primary openings on the sidewall of the valve housing 26 (not shown).

The sliding movement of the blocking member 26 may be effectuated by the activation and deactivation of the valve stem 25. In the embodiment illustrated in FIG. 2, the blocking member 26 is operatively coupled to the valve stem 25. More specifically, the blocking member 26 may be operatively associated with the valve stem 25 through a first spring member 41. The blocking member 26 may also be operatively associated with the valve housing 24 through an optional second spring member 42. The second spring member 42 may be stiffer than the first spring member 41.

Figure 3:
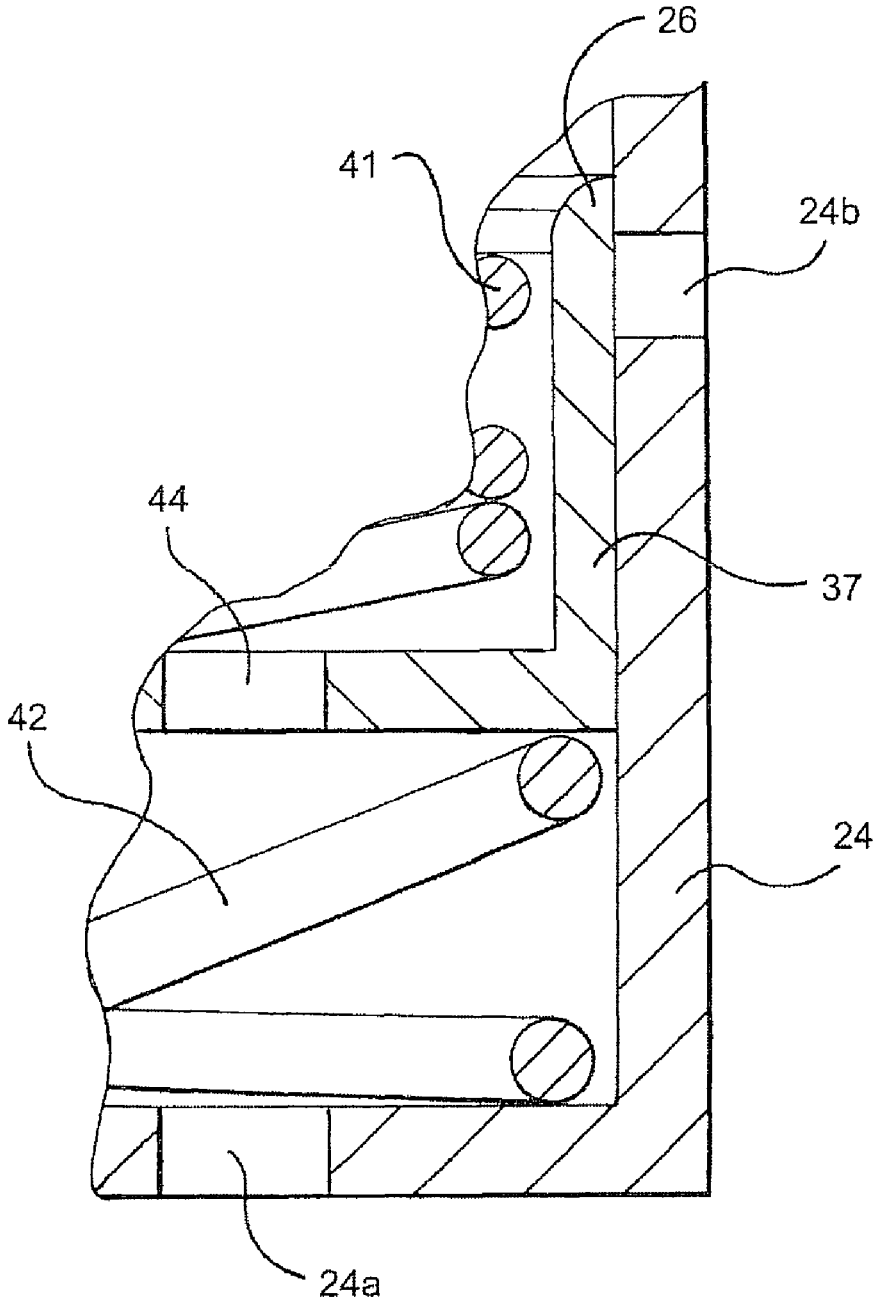
FIG. 3 is an enlarged sectional view of the valve assembly shown in FIG. 2, particularly illustrating the blocking of the secondary opening by the sleeve of the blocking member.

FIGS. 2-3 illustrate the disclosed valve assembly 20 in a non-activated state, with FIG. 3 particularly showing the blocking of the one or more secondary openings 24*b* on the sidewall of the valve housing 24. In the non-activated state, the stem orifice 31 remains blocked by the annular gasket 30 and the one or more secondary openings 24*b* remains blocked by the sleeve 37 of the blocking member 26.

Figure 4:
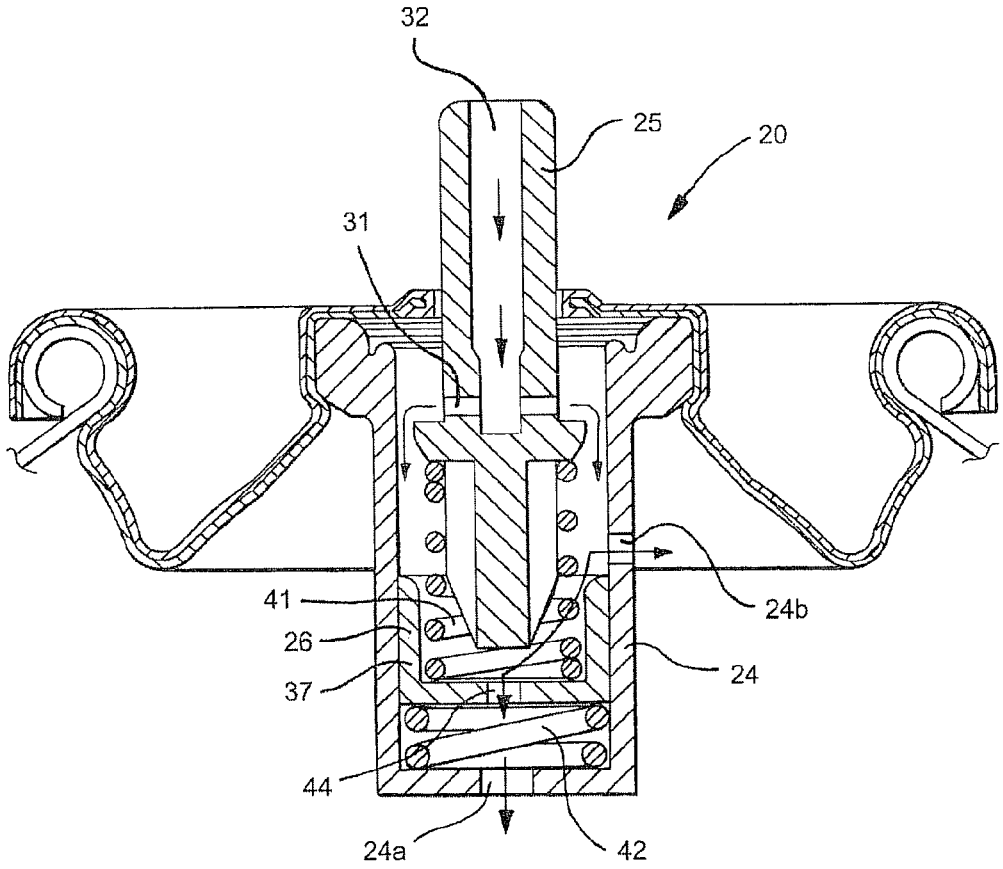
FIG. 4 is a side sectional view of the valve assembly shown in FIG. 2 in a product filling state, particularly illustrating the unblocking of the secondary opening on the sidewall of the valve housing for increasing flow rate during product filling.

Turning to FIG. 4, which illustrates the disclosed valve assembly 20 in a product filling state. In this non-limiting embodiment, the valve stem 25 is activated by a downward force, thereby allowing the stem orifice 31 to be advanced out of the sealed position illustrated in FIGS. 2-3. As a result, fluid communication between the interior of the valve housing 24 and the fluid passageway 32 of the valve stem 25 is established through the stem orifice 31. Further advancement of the valve stem 25 also causes a downward sliding movement of the blocking member 26 from the blocking position illustrated in FIGS. 2-3 to an unblocking position illustrated in FIG. 4, in which the one or more secondary openings 24*b* are no longer blocked by the sleeve 37 of the blocking member 26. Hence, the product can be charged through the fluid passageway 32 and stem orifice 31 into the valve housing 24, and thereafter into the interior of the container 11 through the primary and secondary openings (24*a*, 24*b*), as illustrated by the arrows in FIG. 4. Because the product may be charged into the container 11 through both the primary and secondary openings (24*a*, 24*b*), an increased flow rate during product filling is achieved. After filling, the downward force exerted on the valve stem 25 may be removed. The biasing force of the first and second spring members (41, 42) then urges the valve stem 25 and blocking member 26 to return to their non-activated positions illustrated in FIGS. 2-3.

Figure 5:
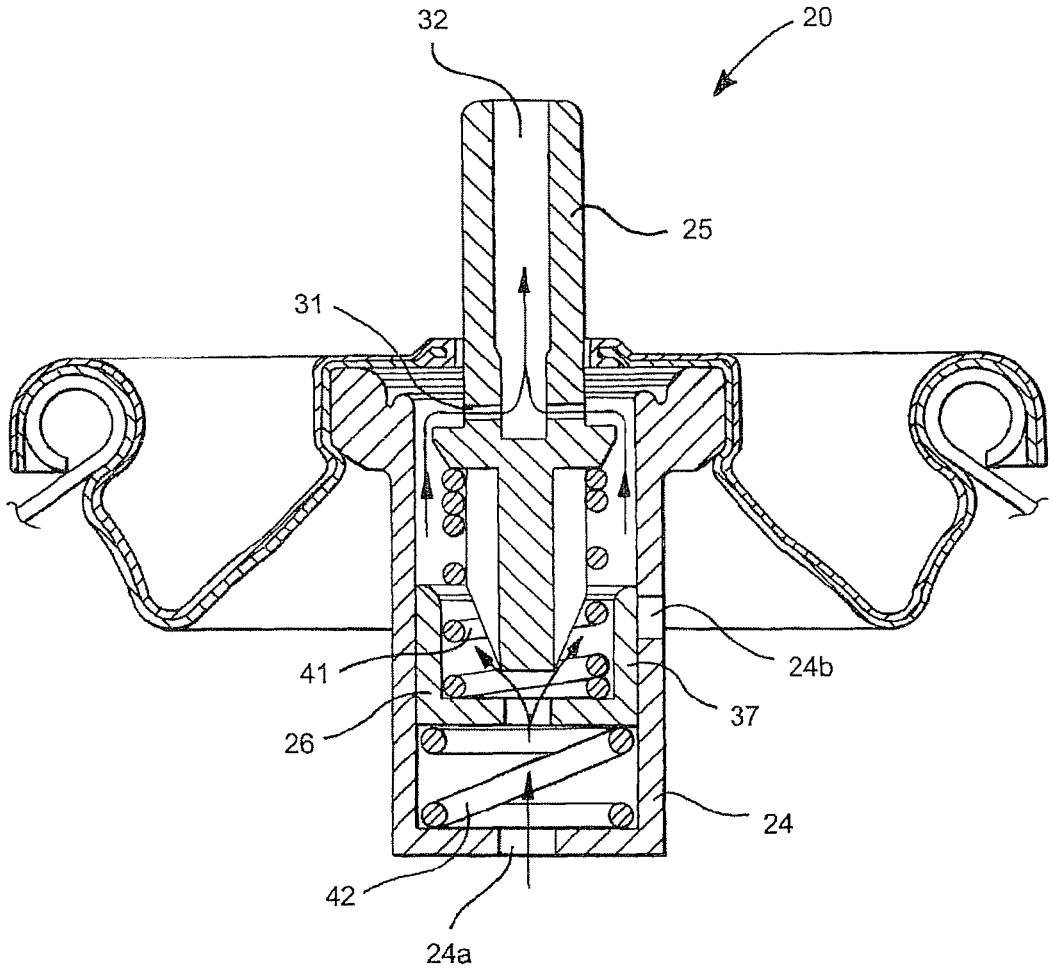
FIG. 5 is a side sectional view of the valve assembly shown in FIG. 2 in a product dispensing state, particularly illustrating the blocking of the secondary opening on the sidewall of the valve housing for retaining a regular flow rate during product dispensing.

Turning now to FIG. 5, the disclosed valve assembly is illustrated in a dispensing state. The valve stem is activated by a downward force sufficient to cause the deformation of the first spring member 41, thereby allowing the stem orifice 31 to establish fluid communication between the interior of the valve housing 24 and the fluid passageway 32 of the valve stem 25. Unlike the downward force exerted during product filling illustrated in FIG. 4, however, the downward force during product dispensing may be insufficient to cause enough downward sliding movement of the blocking member 26 to unblock the secondary opening 24*b* on the sidewall of the valve housing 24. Because the primary opening 24*a* remains unblocked by the blocking member 26, the pressurized product may be dispensed from the interior of the container 11 into the valve housing 24 through the primary opening 24*a*, and thereafter into the fluid passageway 32 through the stem orifice 31, as illustrated by the arrows in FIG. 5. Because the product may be dispensed from the container 11 through only the primary opening 24*a* and not through the secondary opening 24*b*, a regular flow rate during product dispensing is achieved. After filling, the downward force exerted on the valve stem 25 may be removed. The biasing force of the first and second spring members (41, 42) then urges the valve stem 25 and blocking member 26 to return to their non-activated positions illustrated in FIGS. 2-3.

It is to be understood, of course, that the above described embodiment is for illustration purpose only and should not be considered as limiting the scope of this disclosure. Numerous modifications and improvements thereof may be apparent to one of ordinary skill in the art in view of this disclosure without undue experimentation. For example, although the blocking member 26 is shown to be disposed within the valve housing 24, it may also be provided as a slidable sleeve disposed on the exterior sidewall of the valve housing (not shown).

Further, instead of associating the valve stem 25 with the blocking member 26, the first spring member 41 may associate the valve stem 25 with the sidewall or top portion of the valve housing 24, in which case there may not be any additional mechanical association between the valve stem 25 and blocking member 26. In operation, the sliding movement of the blocking member 26 may be initiated by the direct contact between the bottom of the valve stem 25 and the blocking member 26. Still further, although the second spring member 42 is shown to operatively associate the blocking member 26 with the bottom of the valve housing 24, it may be redesigned to operatively associate the blocking member 26 with the sidewall or top portion of the valve housing, as long as the biasing force of the second spring member urges the blocking member 26 to the blocking position illustrated in FIGS. 2-3 and 5.

Turning now to FIGS. 6-10, which illustrate a second embodiment of the disclosed valve assembly 20. In this embodiment, the one or more primary and secondary openings (24*a*, 24*b*) are provided on the bottom of the valve housing 24. The blocking member 26 of the disclosed valve assembly 20 may include a piston plate 47 having one or more transverse primary vents 47*a* and one or more transverse secondary vents 47*b* thereon. The one or more primary vents 47*a* are in longitudinal registry with the one or more primary openings 24*a* on the bottom wall of the valve housing 24, and the one or more secondary vents 47*b* are not in longitudinal registry with the one or more secondary openings 24*b* on the bottom wall of the valve housing 24. The piston plate 47 may be longitudinally slidable within the valve housing 24 so that the engagement/disengagement of the piston plate 47 and the valve housing 24 may selectively block or unblock the one or more secondary openings 24*b* on the bottom of the valve housing 24. Preferably, the blocking member 26 may not block the one or more primary openings 24*a* on the valve housing 24 when the piston plate 47 engages the bottom of the valve housing 24. In the embodiment illustrated in FIG. 6, the blocking member 26 may further include an optional annular sidewall 48 to facilitate the sliding movement of the blocking member 26.

The sliding movement of the blocking member 26 in the second embodiment may also be effectuated by the activation and deactivation of the valve stem 25. In the embodiment illustrated in FIG. 6, the blocking member 26 is operatively associated with the valve stem 25 by a spring member 41. Unlike the first embodiment, however, the blocking member 26 is not in operative association with the bottom of the valve housing 24.

Figure 6:
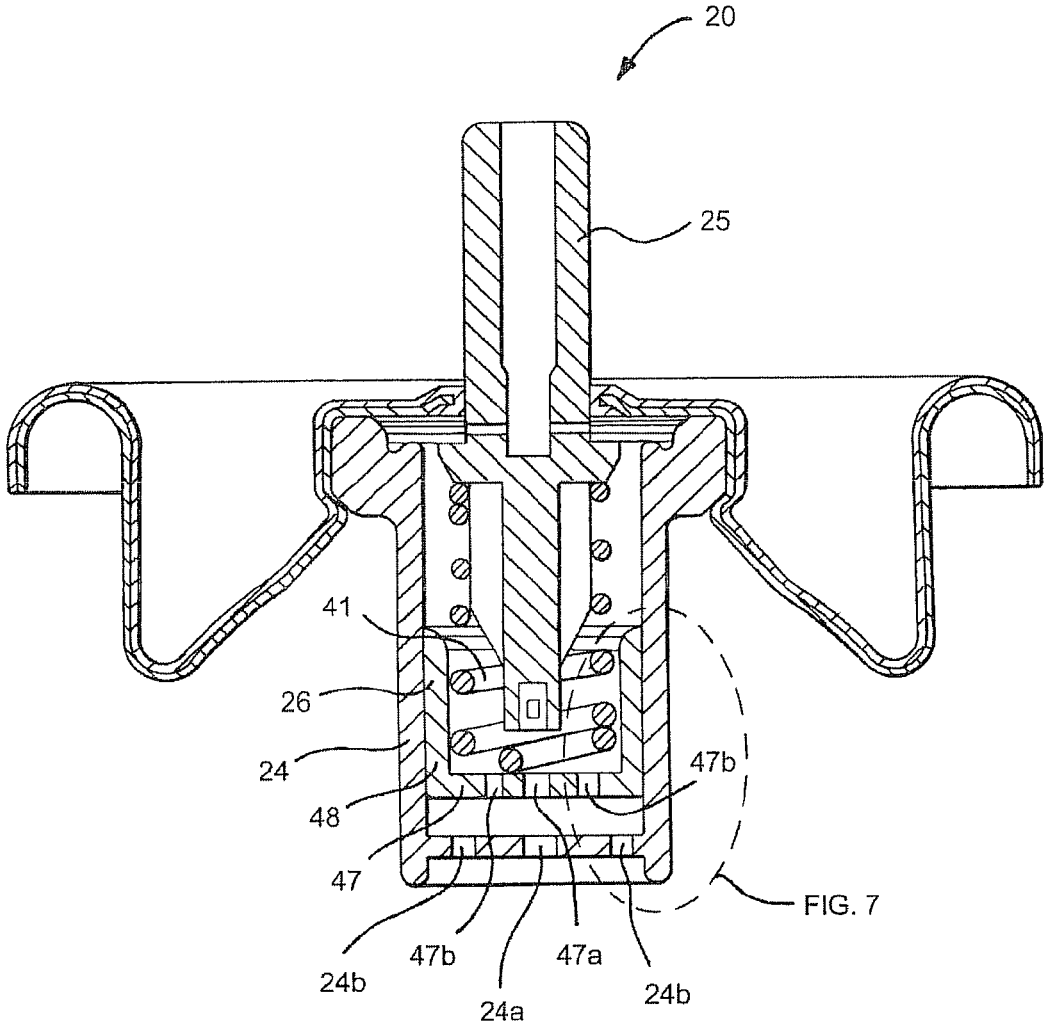
FIG. 6 is a side sectional view of another embodiment of the disclosed valve assembly in accordance with this disclosure.
Figure 7:
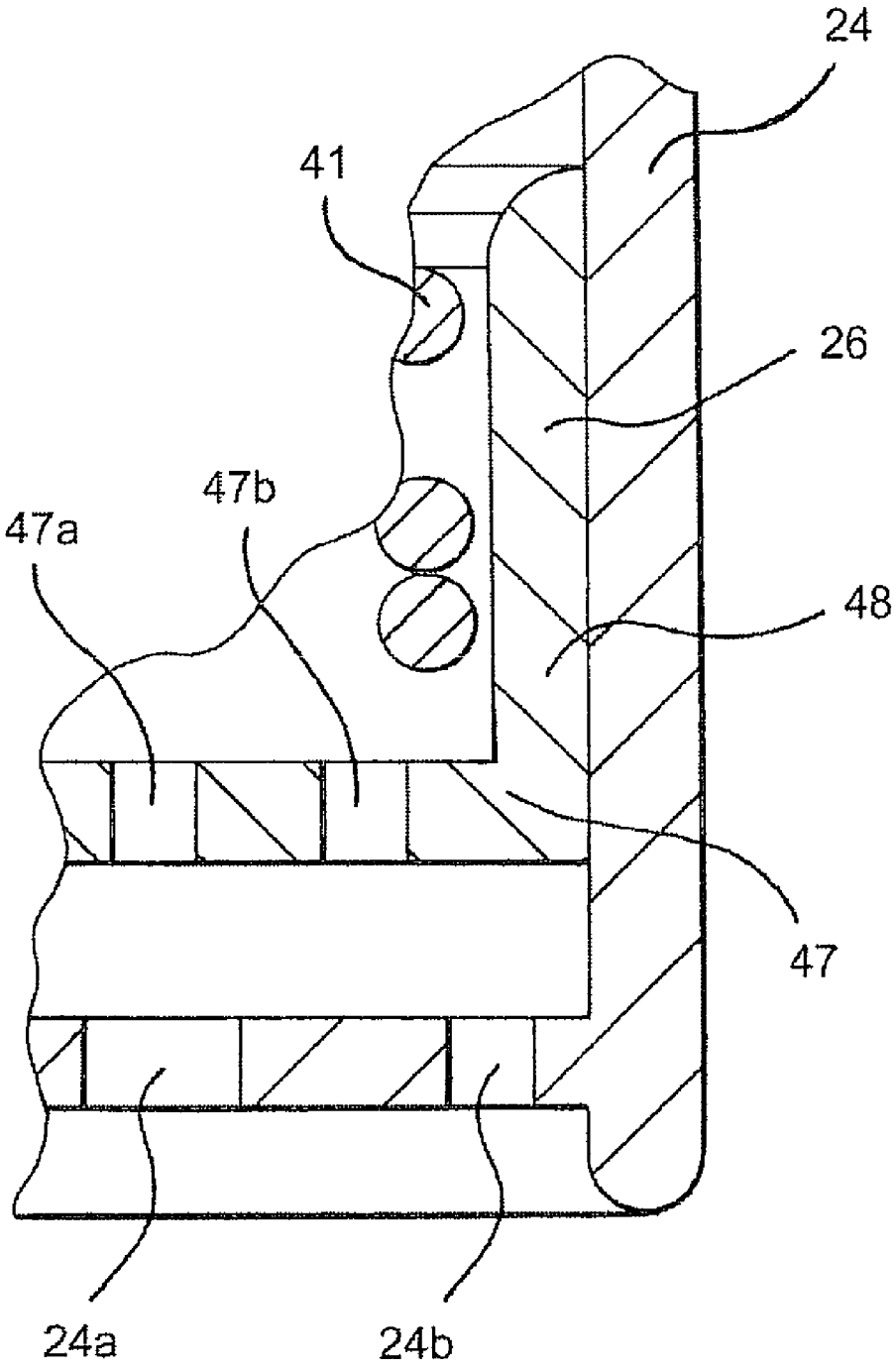
FIG. 7 is an enlarged sectional view of the valve assembly shown in FIG. 6, particularly illustrating the alignment of the primary opening with the primary vent, as well as the misalignment of the secondary openings with the secondary vents.

FIGS. 6-7 illustrate the disclosed valve assembly 20 in a non-activated, pre-filling state, with FIG. 7 particularly showing the alignment/misalignment of the primary and secondary openings (24*a*, 24*b*) with the primary and secondary vents (47*a*, 47*b*). In the non-activated, pre-filling state, the stem orifice 31 remains blocked by the annular gasket 30 and the one or more secondary openings 24*b* remains unblocked by the piston plate 47 of the blocking member 26.

Figure 8:
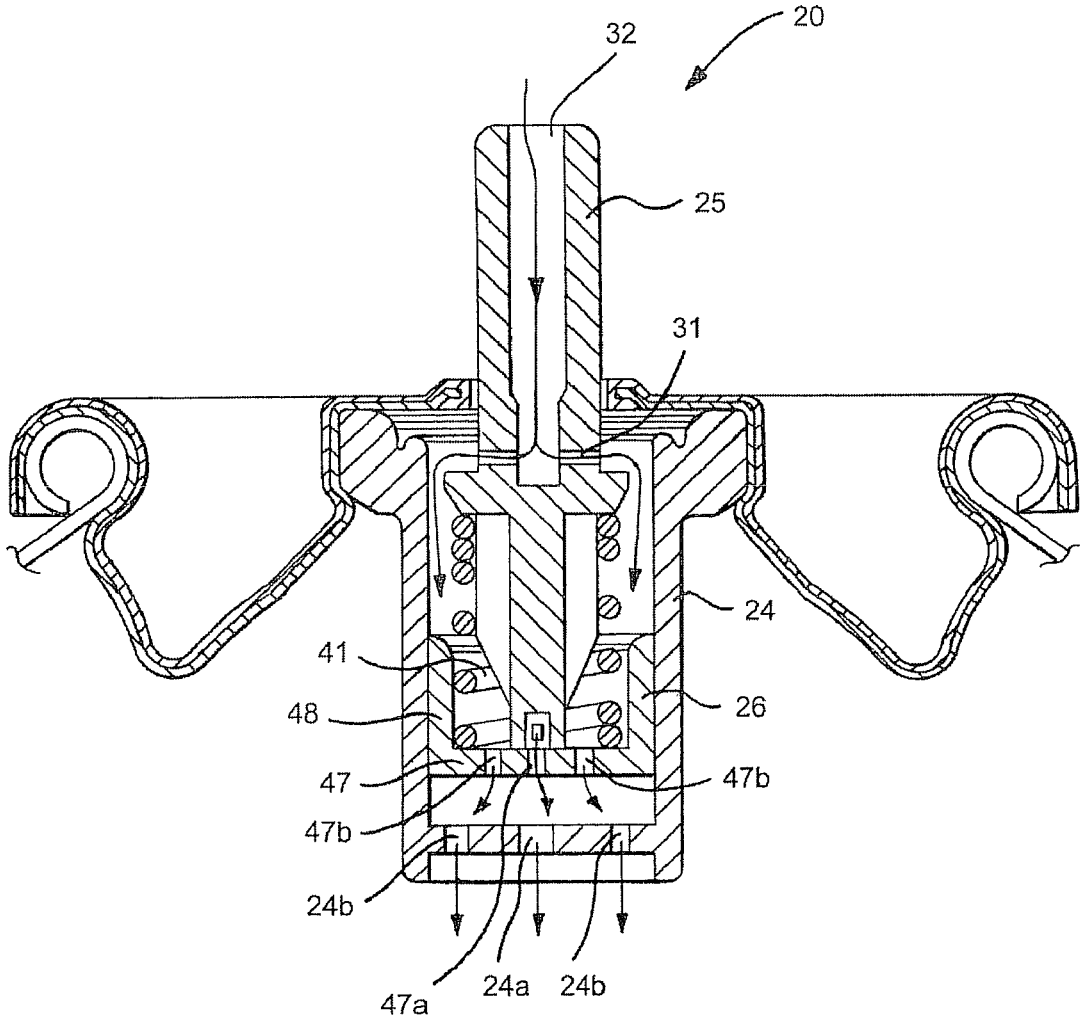
FIG. 8 is a side sectional view of the valve assembly shown in FIG. 6 in a product filling state, particularly illustrating the unblocking of the secondary opening on the bottom of the valve housing for increasing flow rate during product filling.

Turning to FIG. 8, the disclosed valve assembly 20 is illustrated in a product filling state. In this non-limiting embodiment, the valve stem 25 is activated by a downward force, thereby allowing the stem orifice 31 to establish fluid communication between the interior of the valve housing 24 and the fluid passageway 32 of the valve stem 25. During product filling, the valve stem 25 preferably does not advance further to cause the engagement of the piston plate 47 with the bottom of the valve housing 24. Because neither of the primary and secondary openings (24*a*, 24*b*) is blocked by the piston plate 47 of the blocking member 26, the product can be charged through the fluid passageway 32 and stem orifice 31 into the valve housing 24, and thereafter into the interior of the container 11 first through both the primary and secondary vents (47*a*, 47*b*) of the piston plate 47, then through both the primary and secondary openings (24*a*, 24*b*) of the valve housing, as illustrated by the arrows in FIG. 8. Because the product may be charged into the container 11 through the primary and secondary openings (24*a*, 24*b*), an increased flow rate during product filling is achieved.

Figure 9:
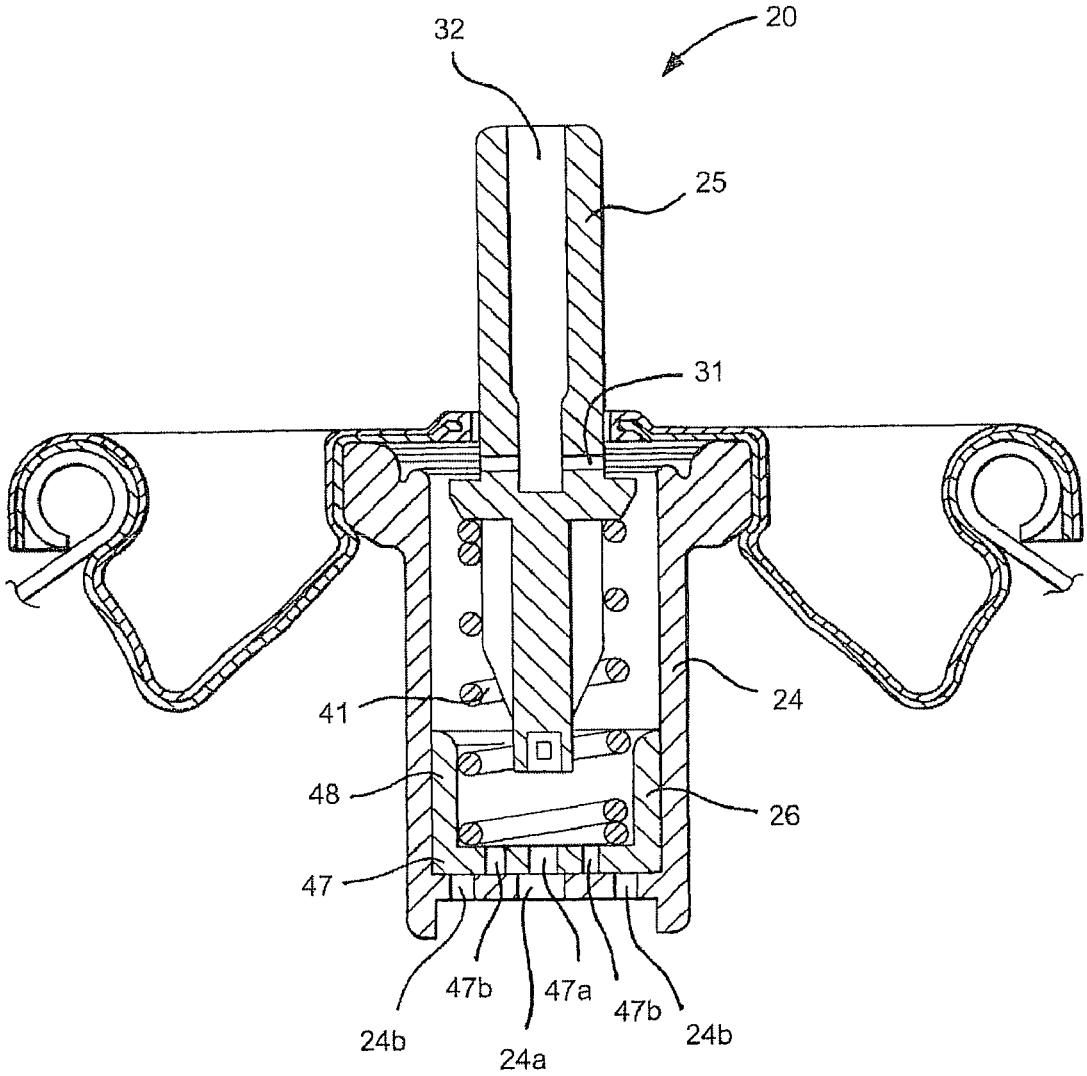
FIG. 9 is a side sectional view of the valve assembly shown in FIG. 6 in a post product filling state, particularly illustrating the engagement of the piston plate with the bottom of the valve housing and the blocking of the secondary openings by the piston plate.

After filling, the valve stem 25 may be further advanced toward the bottom of the valve housing 24. Through the spring member 41 that operatively associates the valve stem 25 with the blocking member 26, the further downward movement of valve stem 25 may be translated to a downward movement of the blocking member 26 toward the bottom of the valve housing 26. The blocking member 26 may be advanced until the piston plate 47 of the blocking member 26 engages the bottom of the valve housing 24, as illustrated in FIG. 9. As a result of such engagement, the secondary openings 24*b* on the valve housing 24, which are not in longitudinal registration with the secondary vents 47*b* of the piston plate 47, are now blocked by the piston plate 47. The primary opening 24*a* on the valve housing, however, remains unblocked because of its longitudinal registration with the primary vent 47*a*. Thereafter, the downward force exerted on the valve stem 25 is removed and the biasing force of the spring member 41 urges the valve stem to retain its original non-activated position, while the piston plate 47 remains engaged with the bottom of the valve housing 24, as illustrated in FIG. 9.

Figure 10:
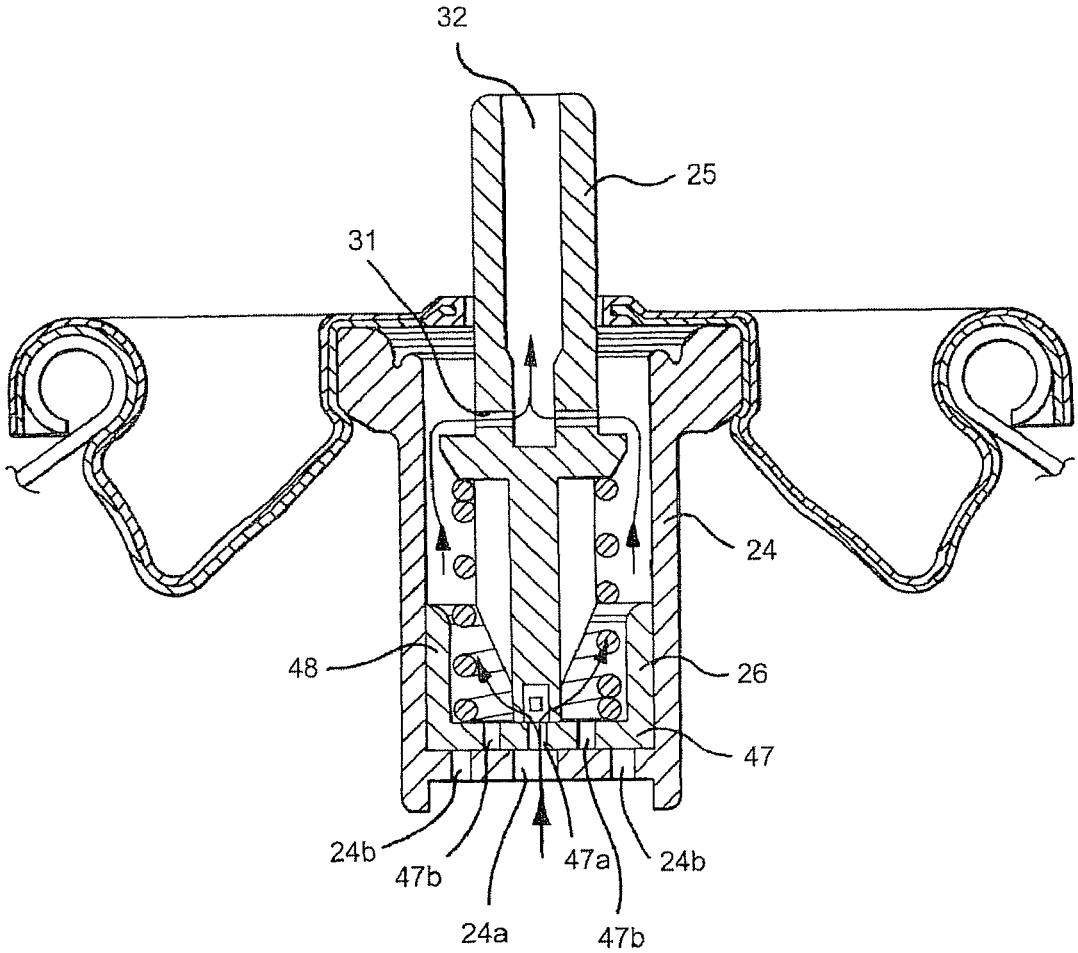
FIG. 10 is a side sectional view of the valve assembly shown in FIG. 6 in a product dispensing state, particularly illustrating the blocking of the secondary opening on the bottom of the valve housing for retaining a regular flow rate during product dispensing.

Turning now to FIG. 10, the disclosed valve assembly 20 is illustrated in a dispensing state. The valve stem 25 is activated by a downward force to allow the stem orifice 31 to establish fluid communication between the interior of the valve housing 24 and the fluid passageway 32 of the valve stem 25. Because the primary opening 24*a* remains unblocked by the piston plate 47 of the blocking member 26, the pressurized product may be dispensed from the interior of the container 11 into the valve housing 26 through the primary opening 24*a* and primary vent 47*a*, and thereafter into the fluid passageway 32 through the stem orifice 31, as illustrated by the arrows in FIG. 10. Because the product may be dispensed from the container 11 through only the primary opening 24*a* and not through the secondary openings 24*b*, a regular flow rate during product dispensing is achieved. After dispensing, the downward force exerted on the valve stem 25 may be removed. The biasing force of the spring member 41 then urges the valve stem 25 to return to its non-activated position, as illustrated in FIG. 9.

It is to be understood, of course, that the above described embodiment is for illustration purpose only and should not be considered as limiting the scope of this disclosure. Numerous modifications and improvements thereof may be apparent to one of ordinary skill in the art in view of this disclosure without undue experimentation. For example, although the blocking member 26 is shown to be disposed within the valve housing 24, it may also be provided as a piston plate disposed on the exterior of the bottom wall of the valve housing (not shown).

Further, instead of operatively associating the valve stem 25 with the blocking member 26, the spring member 41 may operatively associate the valve stem 25 with the valve housing 24, in which case there is no mechanical association between the valve stem 25 and blocking member 26. In operation, the sliding movement of the piston plate 47 may be initiated by the direct contact between the bottom of the valve stem 25 and the piston plate 47.

Figure 11:
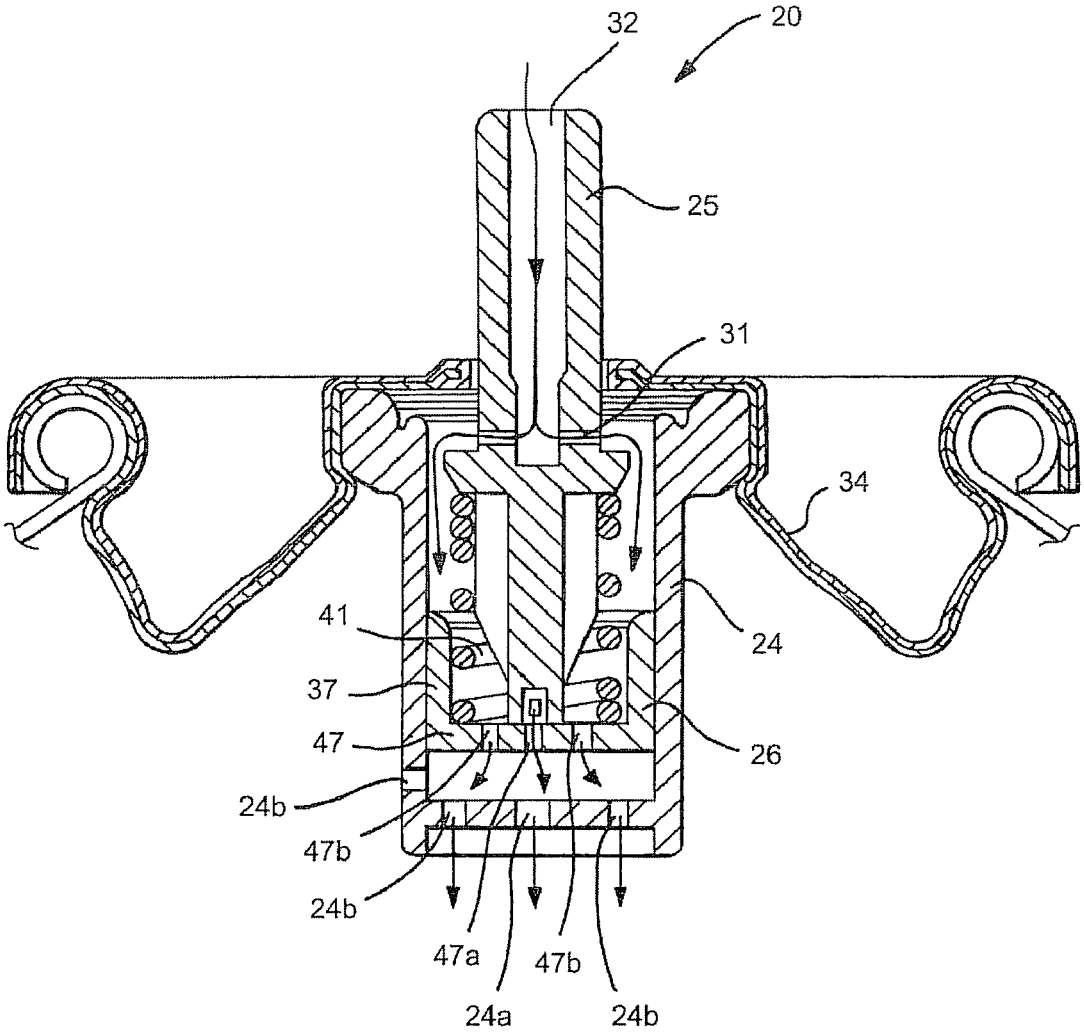
FIG. 11 is a side sectional view of another embodiment of the disclosed valve assembly in accordance with this disclosure.

Still further, the one or more secondary openings 24*b* may be provided both on the sidewall and on the bottom of the valve housing 24, in which case the blocking member 26 may include both the sleeve 37 and the piston plate 47, as illustrated in FIG. 11. During product filling, the blocking member 26 may be positioned so that the sleeve 37 does not block the one or more secondary openings 24*b* on the sidewall of the valve housing 24, and the piston plate 47 is separated from the bottom of the valve housing 24. Accordingly, the product may be charged into the interior of the pressurized container first through the primary and secondary vents (47*a*, 47*b*) on the piston plate, and then through the primary openings 24*a*, as well as the secondary openings 24*b* on the sidewall and bottom of the valve housing 24. After filling, the blocking member 26 may be advanced by the valve stem 25 to engage the bottom of the valve housing 24, thereby blocking the secondary openings 24*b* on the sidewall as well as the bottom of the valve housing 24. Thereafter, the product may be dispensed only through the primary opening 24*a* and primary vent 47*a* and not through any of the secondary openings 24*b* and secondary vents 47*b*. As a result, a regular flow rate during dispensing is achieved.

Because the blocking member 26 functions to block the secondary openings 24*b* on the valve housing 24, the blocking member 26 may be constructed from a material that is substantially rigid and provides acceptable resistance against product and/or propellant permeation. For example, the blocking member 26 may be formed of a metal material, such as aluminum, steel, or any other metal material suitable for use in a pressurized dispenser. In another embodiment, the blocking member 26 may also be manufactured from softer and/or less rigid materials, such as polymeric materials used in piston-type dispensers, to provide better sealing against the valve housing 24. Exemplary polymeric materials include, but are not limited to, polyethylene, high-density polyethylene, and polypropylene. Further, in order to improve the permeation resistance against propellants such as liquefied petroleum gases or compressed gases, the blocking member 26 may be treated with one of many surface modification methods including, but are not limited to, fluorine gas treatment, coatings such as polyvinylidene chloride, vapor-phase metal deposition, incorporation of a barrier plastic, etc.

Moreover, the blocking member 26 or other components of the disclosed valve assembly may include a surface coating to enhance its corrosion resistance during storage or during normal usage when the valve assembly is exposed to the products or propellants. The coatings maybe organic coatings or metallic/plastic laminates used in aerosol cans and aerosol valves, or any other anti-corrosive coatings known in the art. The organic coatings include organosols, epoxides, polyamide-imide compounds, etc. The metallic/plastic coatings may be laminates of polypropylene (or polyethylene or polyester) and steel such as Protact® or Andrafol®.

Numerous modifications and variations of the present invention are possible in light of the above disclosure. It is therefore to be understood that, within the scope of the appended claims, the invention may be practiced otherwise than as specifically described herein. While only certain embodiments have been set forth, alternatives and modifications will be apparent from the above description to those skilled in the art. These and other alternatives are considered equivalents and within the spirit and scope of this disclosure and the appended claims.

What is claimed:

1. A valve assembly for use in a pressurized container, comprising:

a valve housing having at least one primary opening and at least one secondary opening thereon; and a blocking member operatively coupled to the valve housing, the blocking member being slidable from a filling position in which neither of the primary and secondary openings is blocked by the blocking member, to a dispensing position in which the at least one primary opening is not blocked by the blocking member and the at least one secondary opening is blocked by the blocking member.

2. The valve assembly of claim 1, wherein the at least one secondary opening is provided on the sidewall of the valve housing.

3. The valve assembly of claim 1, wherein the at least one secondary opening is provided on the bottom of the valve housing.

4. The valve assembly of claim 1, wherein the at least one primary opening is provided on the bottom of the valve housing.

5. The valve assembly of claim 1, wherein the blocking member is substantially rigid.

6. The valve assembly of claim 1, wherein the blocking member is substantially permeation resistant.

7. The valve assembly of claim 1, wherein the valve assembly further comprises a valve stem.

8. The valve assembly of claim 7, wherein the valve stem is operatively coupled to the blocking member.

9. The valve assembly of claim 7, wherein the valve stem is operatively associated with the blocking member through a spring member.

10. A valve assembly for use in a pressurized container, comprising:

a valve housing having at least one primary opening and at least one secondary opening thereon; and a blocking member operatively coupled to the valve housing and having a surface that slidably engages the valve housing, the blocking member being slidable from a filling position in which neither of the primary and secondary openings is blocked by the blocking member, to a dispensing position in which the at least one primary opening is not blocked by the blocking member and the at least one secondary opening is blocked by the blocking member.

11. The valve assembly of claim 10, wherein the at least one secondary opening is provided on the sidewall of the valve housing.

12. The valve assembly of claim 10, wherein the at least one secondary opening is provided on the bottom of the valve housing.

13. The valve assembly of claim 10, wherein the at least one primary opening is provided on the bottom of the valve housing.

14. The valve assembly of claim 10, wherein the blocking member is substantially rigid and permeation resistant.

15. The valve assembly of claim 1, wherein the valve assembly further comprises a valve stem operatively coupled to the blocking member.

16. A valve assembly for use in a pressurized container, comprising:

a valve housing having at least one primary opening and at least one secondary opening thereon; and a blocking member having a sleeve slidably disposed within the valve housing, the exterior surface of the sleeve engaging the interior surface of the valve housing, the sleeve being slidable from a filling position in which neither of the primary and secondary openings is blocked by the sleeve, to a dispensing position in which the primary opening is not blocked by the sleeve and the secondary opening is blocked by the sleeve.

17. The valve assembly of claim 16, wherein the at least one secondary opening is provided on the sidewall of the valve housing.

18. The valve assembly of claim 16, wherein the at least one primary opening is provided on the bottom of the valve housing.

19. The valve assembly of claim 16, wherein the blocking member is substantially rigid and permeation resistant.

20. The valve assembly of claim 16, wherein the valve assembly further comprises a valve stem operatively coupled to the blocking member.

21. A valve assembly for use in a pressurized container, comprising:

a valve housing having at least one primary opening and at least one secondary opening thereon; and a blocking member having a piston plate slidably disposed within the valve housing, the piston plate comprising at least one primary vent and at least one secondary vent thereon, the at least one primary opening being in longitudinal registry with the at least one primary vent, the at least one secondary opening being not in longitudinal registry with the at least one secondary vent, the piston plate being slidable from a filling position in which neither of the primary and secondary openings is blocked by the piston plate, to a dispensing position in which the primary opening is not blocked by the piston plate and the secondary opening is blocked by the piston plate.

22. The valve assembly of claim 21, wherein the at least one secondary opening is provided on the bottom of the valve housing.

23. The valve assembly of claim 21, wherein the at least one primary opening is provided on the bottom of the valve housing.

24. The valve assembly of claim 21, wherein the blocking member is substantially rigid and permeation resistant.

25. The valve assembly of claim 21, wherein the valve assembly further comprises a valve stem operatively coupled to the blocking member.

* * * * *